US010059566B2

(12) United States Patent
Witczak et al.

(10) Patent No.: US 10,059,566 B2
(45) Date of Patent: Aug. 28, 2018

(54) CONNECTING CARS IN A MULTICAR ELEVATOR SYSTEM

(71) Applicant: OTIS ELEVATOR COMPANY, Farmington, CT (US)

(72) Inventors: Tadeusz Witczak, Bethel, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 179 days.

(21) Appl. No.: 14/888,745

(22) PCT Filed: May 7, 2013

(86) PCT No.: PCT/US2013/039862
§ 371 (c)(1),
(2) Date: Nov. 3, 2015

(87) PCT Pub. No.: WO2014/182284
PCT Pub. Date: Nov. 13, 2014

(65) Prior Publication Data

US 2016/0075534 A1 Mar. 17, 2016

(51) Int. Cl.

| | |
|---|---|
| ***B66B 9/00*** | (2006.01) |
| ***B66B 9/02*** | (2006.01) |
| ***B66B 1/24*** | (2006.01) |

(52) U.S. Cl.
CPC ..... *B66B 9/003* (2013.01); *B66B 1/2491* (2013.01); *B66B 9/00* (2013.01); *B66B 9/02* (2013.01); *B66B 2009/006* (2013.01)

(58) Field of Classification Search
CPC .. B66B 9/003; B66B 9/00; B66B 9/02; B66B 1/2491
See application file for complete search history.

(56) References Cited

U.S. PATENT DOCUMENTS 1,837,643 A * 12/1931 Anderson ..... B66B 9/00 187/249
3,658,155 A * 4/1972 Salter ..... B66B 9/00 187/270

(Continued)

FOREIGN PATENT DOCUMENTS

CN 102325714 A 1/2012
EP 1357075 A1 10/2003

(Continued)

OTHER PUBLICATIONS

International Search Report for application PCT/US2013/039862, dated Feb. 5, 2014, 5 pages.

(Continued)

*Primary Examiner* — Michael A Riegelman
(74) *Attorney, Agent, or Firm* — Cantor Colburn LLP

(57) ABSTRACT

An elevator system includes a first hoistway having a shuttle section and serviced floors; a second hoistway having a shuttle section and serviced floors; a first elevator car; a second elevator car; a coupler physically connecting the first elevator car and the second elevator car during travel in the shuttle section; an upper transfer station for transferring at least one of the first elevator car and the second elevator car from the first hoistway to the second hoistway; a lower transfer station for transferring at least one of the first elevator car and the second elevator car from the second hoistway to the first hoistway.

10 Claims, 9 Drawing Sheets

(56) References Cited

U.S. PATENT DOCUMENTS 5,288,956 A 2/1994 Kadokura et al.
5,861,587 A 1/1999 Powell et al.
5,907,136 A * 5/1999 Hongo ..... B66B 1/42 187/249
9,738,492 B2 * 8/2017 King ..... B66B 9/00
9,758,347 B2 * 9/2017 Dudde ..... B66B 9/00
9,790,056 B2 * 10/2017 King ..... B66B 9/00
2003/0000778 A1 * 1/2003 Smith ..... B66B 1/30 187/289
2003/0217893 A1 * 11/2003 Dunser ..... B66B 1/2466 187/249
2005/0077115 A1 * 4/2005 Urata ..... B66B 9/00 187/383
2005/0087402 A1 * 4/2005 Haegi ..... B66B 1/2458 187/383
2006/0163008 A1 * 7/2006 Godwin ..... B66B 9/00 187/288
2007/0039785 A1 * 2/2007 Smith ..... B66B 1/18 187/383
2008/0093177 A1 * 4/2008 Fargo ..... B66B 7/068 187/249
2008/0173503 A1 * 7/2008 Schupfer ..... B66B 11/02 187/401
2011/0042168 A1 * 2/2011 Grundmann ..... B66B 9/00 187/249
2012/0006626 A1 * 1/2012 Adifon ..... B66B 7/08 187/249
2012/0037462 A1 * 2/2012 Urben ..... B66B 11/0206 187/401
2012/0097484 A1 * 4/2012 Cortona ..... B66B 11/022 187/249
2012/0312636 A1 * 12/2012 Cortona ..... B66B 1/42 187/249
2013/0306408 A1 * 11/2013 Jacobs ..... B66B 11/0095 187/249
2014/0291074 A1 * 10/2014 Bjorni ..... B66B 9/00 187/249
2015/0083524 A1 * 3/2015 King ..... B66B 9/00 187/249
2015/0368071 A1 * 12/2015 Witczak ..... B66B 9/02 187/250
2016/0046464 A1 * 2/2016 Piech ..... B66B 9/003 187/249
2016/0297640 A1 * 10/2016 Witczak ..... B66B 1/2466
2016/0297646 A1 * 10/2016 Piech ..... B66B 11/04
2016/0297648 A1 * 10/2016 Witczak ..... B66B 11/04
2016/0304316 A1 * 10/2016 Witczak ..... B66B 11/0407
2016/0304317 A1 * 10/2016 Witczak ..... B66B 11/04
2017/0029245 A1 * 2/2017 Olthuis ..... B66B 5/027
2017/0057784 A1 * 3/2017 Witczak ..... B66B 7/02
2017/0088396 A1 * 3/2017 Fargo ..... B66B 1/32
2017/0233218 A1 * 8/2017 Zheng ..... B66B 1/2491 187/247

FOREIGN PATENT DOCUMENTS

JP H04153187 A 5/1992
JP 06080348 A 3/1994
JP H06156951 A 6/1994
JP 11335037 A 12/1999
JP 2000086121 A 3/2000
WO 2008136692 A2 11/2008
WO 2012154178 A1 11/2012

OTHER PUBLICATIONS

Written Opinion for application PCT/US2013/039862, dated Feb. 5, 2014, 5 pages.
Chevailler, S. et al., "Linear Motors for Multi Mobile Systems", 2005 IEEE Industry Applications Conference, Oct. 2-6, 2005, pp. 2099-2016.
Chinese First Office Action for CN application 201380076394.2, dated Nov. 15, 2016, 16 pages.
European Search Report for application EP 13884081.4, dated Nov. 18, 2016, 39pgs.

* cited by examiner

CONNECTING CARS IN A MULTICAR ELEVATOR SYSTEM

FIELD OF INVENTION

The subject matter disclosed herein relates generally to the field of elevator systems, and more particularly, to connecting cars in a multicar elevator system.

BACKGROUND

Multicar elevator systems allow more than one car to travel in a hoistway at a time. Typically, elevator cars in a first hoistway travel up and elevator cars in a second hoistway travel down. This allows more cars to be used to accommodate traffic demands. In buildings with a large number of floors (e.g., high rise or super high rise buildings), the hoistways may include shuttle sections, where no floors are serviced. In the shuttle sections, the goal is to move the elevator cars quickly to reach the serviced floors to reduce passenger wait times. When multiple cars are used in a shuttle section of a hoistway, controlling the elevator car spacing is important to prevent elevator car collision. Elevator car speed may need to be reduced in the shuttle section to ensure proper spacing between the elevator cars. This speed reduction increases wait time for passengers at the serviced floors.

SUMMARY

According to an exemplary embodiment of the invention, an elevator system includes a first hoistway having a shuttle section and serviced floors; a second hoistway having a shuttle section and serviced floors; a first elevator car; a second elevator car; a coupler physically connecting the first elevator car and the second elevator car during travel in the shuttle section; an upper transfer station for transferring at least one of the first elevator car and the second elevator car from the first hoistway to the second hoistway; a lower transfer station for transferring at least one of the first elevator car and the second elevator car from the second hoistway to the first hoistway.

According to another exemplary embodiment of the invention, a method of operating an elevator system includes physically coupling a first elevator car and a second elevator car; directing the first elevator car and the second elevator car upward in a shuttle section of a first hoistway; transferring the first elevator car and the second elevator car from the first hoistway to a second hoistway; and directing the first elevator car and a second elevator car downward in the second hoistway, the first elevator car and the second elevator car being coupled prior to traveling downward in a shuttle section of the second hoistway.

According to another exemplary embodiment of the invention, a multicar elevator system for a building includes a plurality of elevator cars; a plurality of hoistways in which the plurality of elevator cars are able to travel; each of the plurality of hoistways comprising, at least one service zone configured to allow for the loading and unloading of passengers at a plurality of landing floors, at least one shuttle zone configured to allow the passage of the plurality of elevator cars without loading or unloading of passengers, and at least one transfer station, configured to allow transfer of at least one of the elevator cars between at least two of the plurality of hoistways; and a plurality of coupling devices to selectively rigidly couple at least two of the plurality of elevator cars.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
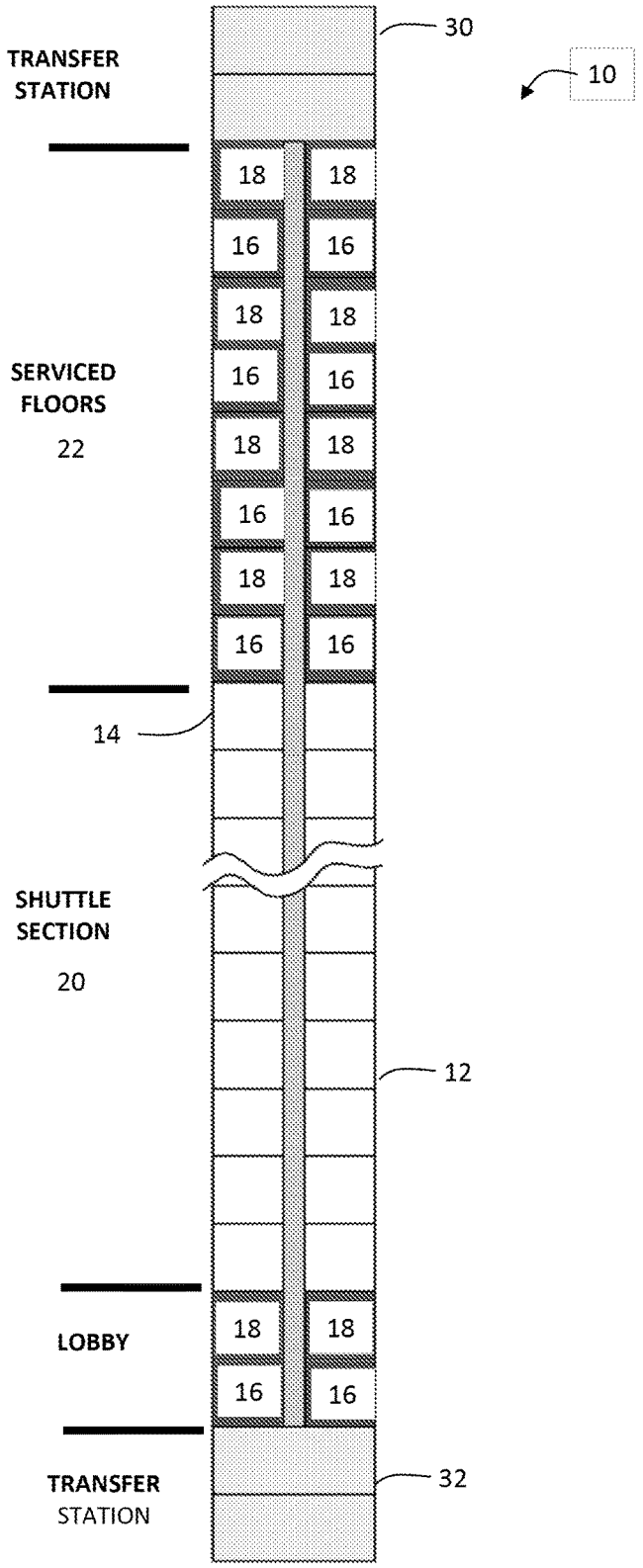
FIG. 1 depicts a multicar elevator system in an exemplary embodiment.

FIG. 1 depicts an elevator system 10 in an exemplary embodiment. Elevator system 10 includes a first hoistway 12 in which elevators cars travel upward. Elevator system 10 includes a second hoistway 14 in which elevators cars travel downward. A first elevator car 16 and a second elevator car 18 may be physically coupled, through a coupler, so that the first elevator car 16 and second elevator car 18 travel together.

Elevator system 10 transports elevators cars 16 and 18 from a first floor (e.g., a lobby), through a shuttle section 20 to serviced floors 22. Above the top floor of the serviced floors 22, is an upper transfer station 30 imparts horizontal motion to elevator cars 16 and 18 to move elevator cars 16 and 18 from the first hoistway 12 to the second hoistway 14. It is understood that upper transfer station 30 may be located at the top floor, rather than above the top floor. Upper transfer station 30 transfers both the first elevator car 16 and the second elevator car 18 at the same time, so that the first elevator car 16 and the second elevator car 18 remain connected during the horizontal transfer between first hoistway 12 and the second hoistway 14.

Below the lobby is a lower transfer station 32 to impart horizontal motion to elevator cars 16 and 18 to move elevator cars 16 and 18 from the second hoistway 14 to the first hoistway 12. It is understood that lower transfer station 32 may be located at the first floor, rather than below the first floor. Lower transfer station 32 transfers both the first elevator car 16 and the second elevator car 18 at the same time, so that the first elevator car 16 and the second elevator car 18 remain connected during the horizontal transfer between second hoistway 14 and the first hoistway 12.

Figure 2:
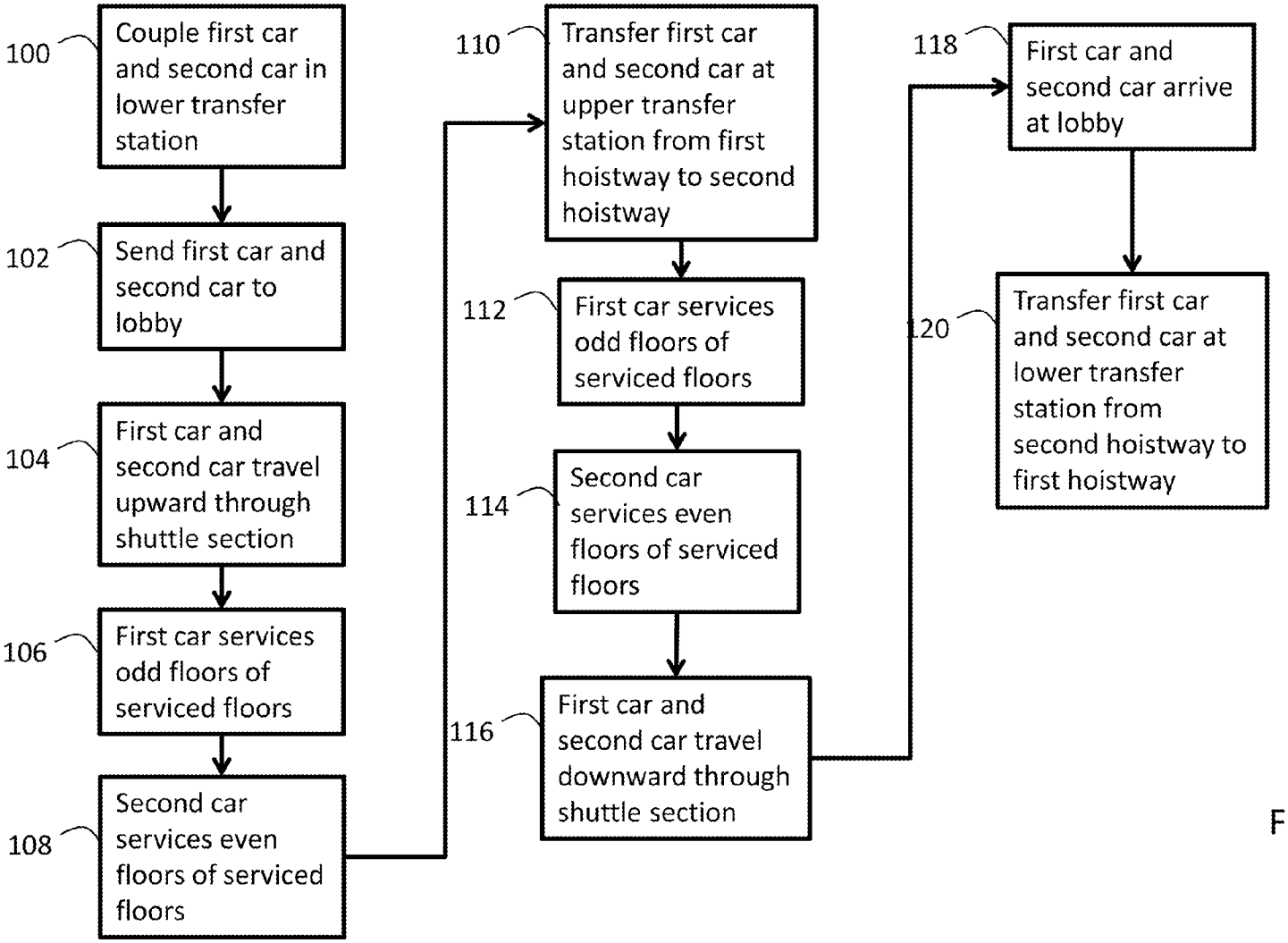
FIG. 2 is a flowchart of a process for operating the elevator system of FIG. 1 in an exemplary embodiment.

FIG. 2 is a flowchart of a process for operating the elevator system of FIG. 1 in an exemplary embodiment. The process begins at 100 where the first car 16 and second 18 are physically coupled. This may be done using known couplers, such as electro-mechanical couplers, electro-magnetic couplers, etc. First elevator car 16 and second elevator car 18 may be coupled at the lower transfer station 32, but it is understood that the first elevator car 16 and second elevator car 18 may be coupled at other locations.

At 102, the coupled first elevator car 16 and second elevator car 18 are sent to the lobby. Passengers may be notified of the floors that first elevator car 16 and second elevator car 18 serve, respectively, so that passengers board the appropriate elevator car. At 104, the first elevator car 16 and second elevator car 18 travel upwards through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

The first elevator car 16 and second elevator car 18 reach the serviced floors 22. The first elevator car 16 and second elevator car 18 remain coupled. As such, first elevator car 16 services a first subset of serviced floors 22 (e.g., the odd floors) at 106 and second elevator car 18 services a second subset of serviced floors 22 (e.g., the even floors) at 108.

Upon traversing the serviced floors 22, first elevator car 16 and second elevator car 18 enter the upper transfer station 30. At 110, the coupled first elevator car 16 and second elevator car 18 are transferred horizontally from the first hoistway 12 to the second hoistway 14. Once transferred, first elevator car 16 and second elevator car 18 begin travel downwards.

The first elevator car 16 and second elevator car 18 enter the serviced floors 22. The first elevator car 16 and second elevator car 18 remain coupled. As such, first elevator car 16 services the first subset of serviced floors (e.g., the odd floors) at 112 and second elevator car 18 services the second subset of serviced floors (e.g., the even floors) at 114.

At 116, the first elevator car 16 and second elevator car 18 travel downwards through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

At 118, first elevator car 16 and second elevator car 18 reach the lobby to allow egress of passengers. Typically, no passengers enter first elevator car 16 or second elevator car 18 at the lobby floor of second hoistway 14. At 120, the coupled first elevator car 16 and second elevator car 18 enter lower transfer station 32 and are transferred horizontally from the second hoistway 14 to the first hoistway 12. Once transferred, first elevator car 16 and second elevator car 18 begin travel upwards, as shown at 102.

Figure 3:
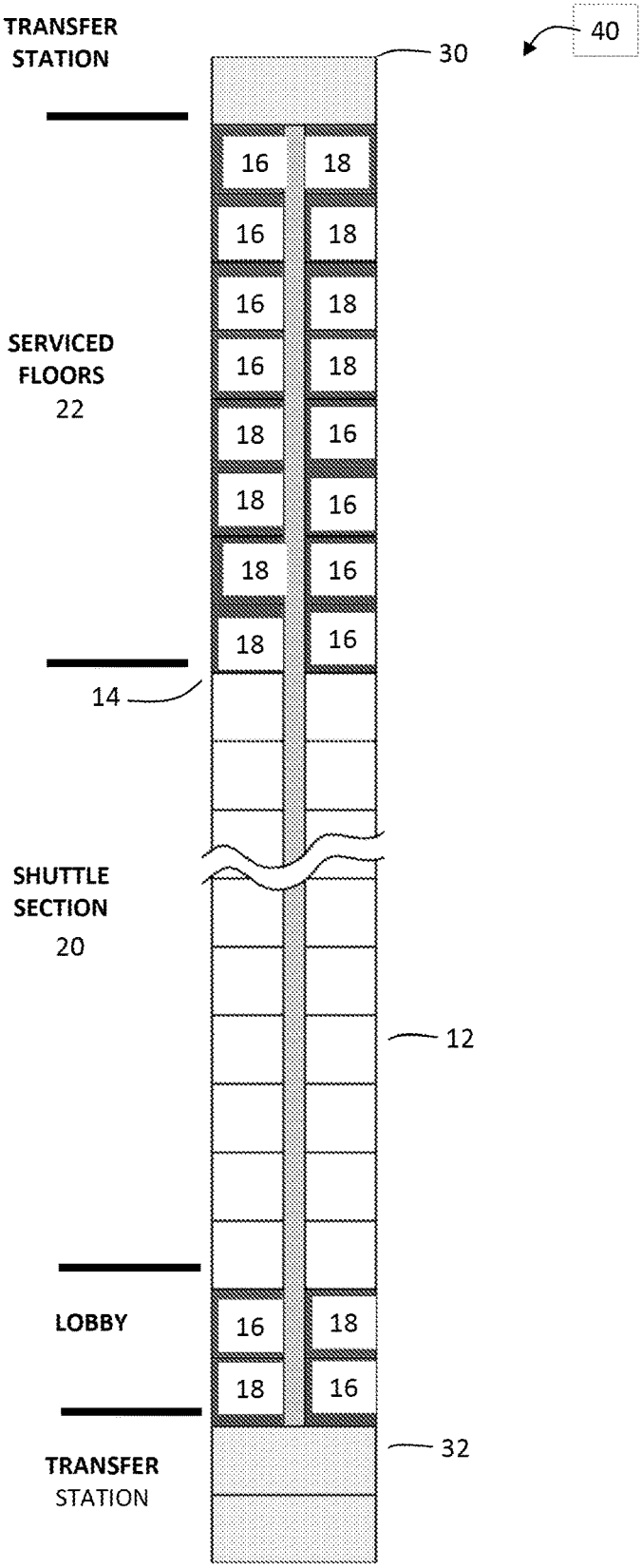
FIG. 3 depicts a multicar elevator system in an exemplary embodiment.

FIG. 3 depicts an elevator system 40 in an exemplary embodiment. In elevator system 40, upper transfer station 30 only accommodates one car at a time, rather than two cars. In elevator system 40, first elevator car 16 and second elevator car 18 are decoupled when traveling in the serviced floors 22.

Figure 4:
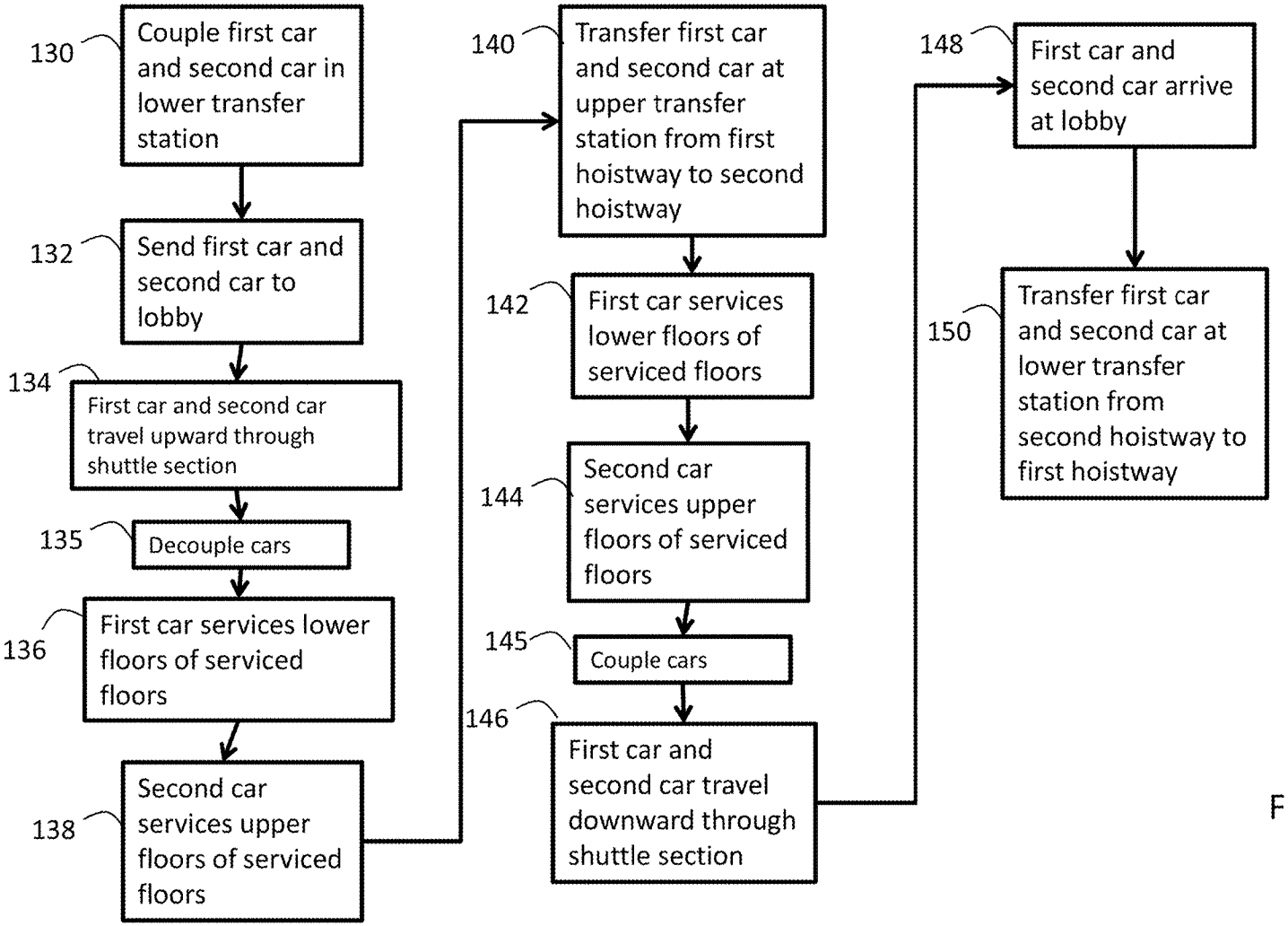
FIG. 4 is a flowchart of a process for operating the elevator system of FIG. 3 in an exemplary embodiment.

FIG. 4 is a flowchart of a process for operating the elevator system of FIG. 3 in an exemplary embodiment. The process begins at 130 where the first car 16 and second 18 are physically coupled. This may be done using known couplers, such as electro-mechanical couplers, electro-magnetic couplers, etc. First elevator car 16 and second elevator car 18 may be coupled at the lower transfer station 32, but it is understood that the first elevator car 16 and second elevator car 18 may be coupled at other locations.

At 132, the coupled first elevator car 16 and second elevator car 18 are sent to the lobby. Passengers may be notified of the floors that first elevator car 16 and second elevator car 18 serve, respectively, so that passengers board the appropriate elevator car. At 134, the first elevator car 16 and second elevator car 18 travel upwards through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

The first elevator car 16 and second elevator car 18 reach the serviced floors 22. At 135, the first elevator car 16 and second elevator car 18 are decoupled. The coupler joining first elevator car 16 and second elevator car 18 may be activated or deactivated by a controller. For example, an electro-mechanical coupler or electro-magnetic coupler may be controlled by control signals from a controller, as described herein with reference to FIG. 9. Once decoupled, first elevator car 16 services a first subset of serviced floors 22 (e.g., the lower floors) at 136 and second elevator car 18 services a second subset of serviced floors 22 (e.g., the upper floors) at 138.

Upon traversing the serviced floors, first elevator car 16 and second elevator car 18 enter the upper transfer station 30. At 140, the second elevator car 18 and first elevator car 16 are sequentially transferred horizontally from the first hoistway 12 to the second hoistway 14. The first elevator car 16 and second elevator car 18 change vertical orientation, e.g., the second elevator car 18 is now vertically below the first elevator car 16. Once transferred, first elevator car 16 and second elevator car 18 begin travel downward in the second hoistway 14.

The first elevator car 16 and second elevator car 18 enter the serviced floors 22. The first elevator car 16 and second elevator car 18 remain decoupled. As such, second elevator car 18 services the first subset of serviced floors (e.g., the lower floors) at 142 and first elevator car 16 services the second subset of serviced floors (e.g., the upper floors) at 144.

At 145, prior to entering shuttle section 20, first elevator car 16 and second elevator car 18 are coupled together. As noted above, the coupler joining first elevator car 16 and second elevator car 18 may be controlled by a controller. At 146, the first elevator car 16 and second elevator car 18 travel downward through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

At 148, first elevator car 16 and second elevator car 18 reach the lobby to allow egress of passengers. Typically, no passengers enter first elevator car 16 or second elevator car 18 at the lobby floor of second hoistway 14. At 150, the coupled first elevator car 16 and second elevator car 18 enter lower transfer station 32 and are transferred horizontally from the second hoistway 14 to the first hoistway 12. Once transferred, first elevator car 16 and second elevator car 18 begin travel upwards, as shown at 132.

Figure 5:
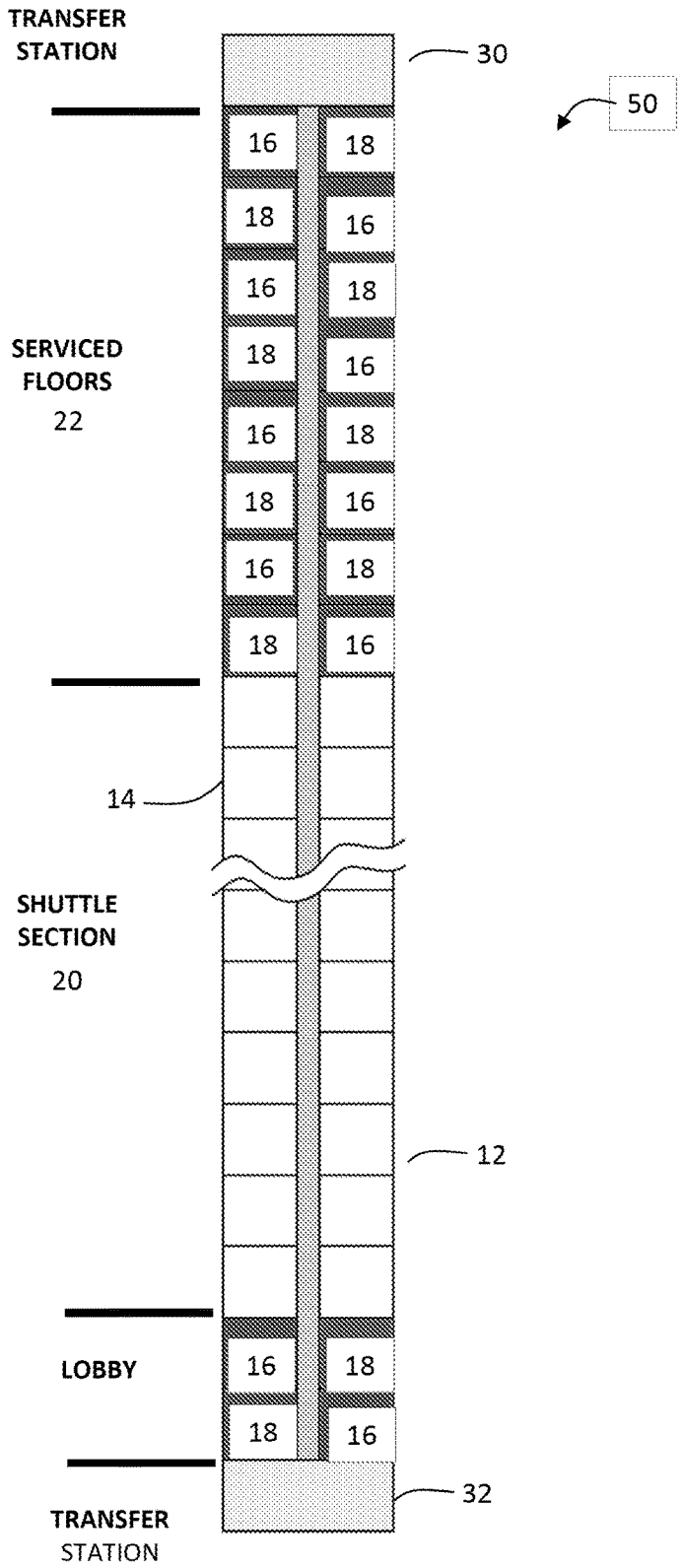
FIG. 5 depicts a multicar elevator system in an exemplary embodiment.

FIG. 5 depicts an elevator system 50 in an exemplary embodiment. The construction of elevator system 50 is similar to that of FIG. 1. In elevator system 50, however, upper transfer station 30 and lower transfer station 32 only accommodate one car at a time, rather than two cars.

Figure 6:
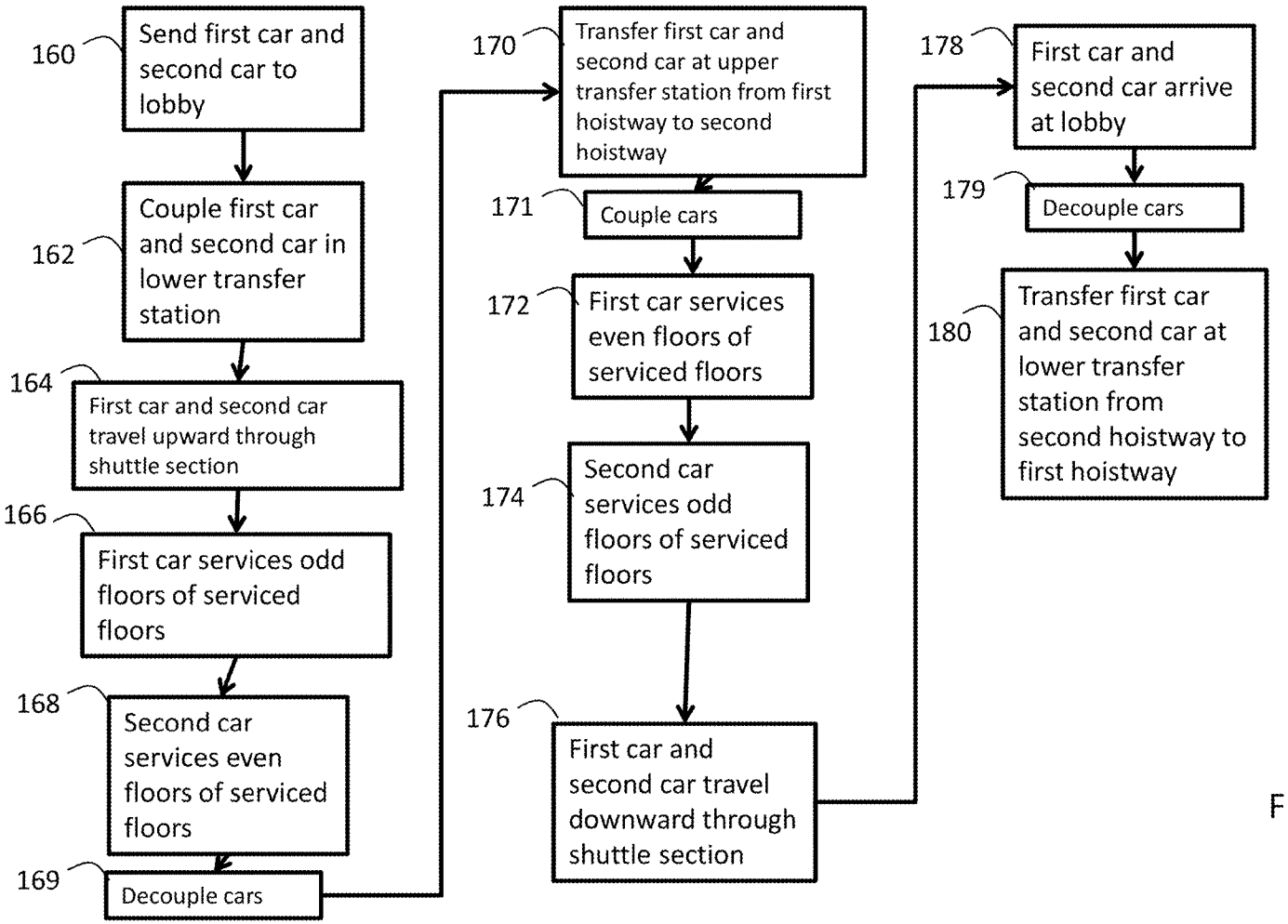
FIG. 6 is a flowchart of a process for operating the elevator system of FIG. 5 in an exemplary embodiment.

FIG. 6 is a flowchart of a process for operating the elevator system of FIG. 5 in an exemplary embodiment. The process begins at 160 where the first car 16 and second car 18 are sent to the lobby. Passengers may be notified of the floors that first elevator car 16 and second elevator car 18 serve, respectively, so that passengers board the appropriate elevator car. At 162, first car 16 and second car 18 are physically coupled by a coupler. This may be done using known couplers, such as electro-mechanical couplers, electro-magnetic couplers, etc.

At 164, the first elevator car 16 and second elevator car 18 travel upward through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

The first elevator car 16 and second elevator car 18 reach the serviced floors 22. First elevator car 16 and second elevator car 18 remain coupled. As such, first elevator car 16 services a first subset of serviced floors 22 (e.g., the odd floors) at 166 and second elevator car 18 services a second subset of serviced floors 22 (e.g., the even floors) at 168.

At 169, the first elevator car 16 and second elevator car 18 are decoupled. The coupler joining first elevator car 16 and second elevator car 18 may be activated or deactivated by a controller. For example, an electro-mechanical coupler or electro-magnetic coupler may be controlled by control signals from a controller.

Once decoupled, the second car 18 and first car 16 enter the upper transfer station 30, one at a time. At 170, the second elevator car 18 and first elevator car 16 are sequentially transferred horizontally from the first hoistway 12 to the second hoistway 14. The first elevator car 16 and second elevator car 18 change vertical orientation, e.g., the second elevator car 18 is now vertically below the first elevator car 16.

At 171, the first elevator car 16 and second elevator car 18 are coupled. The coupler joining first elevator car 16 and second elevator car 18 may be activated or deactivated by a controller. For example, an electro-mechanical coupler or electro-magnetic coupler may be controlled by control signals from a controller. Once coupled, first elevator car 16 and second elevator car 18 begin travel downward in the second hoistway 14.

The first elevator car 16 and second elevator car 18 service the serviced floors 22. Due to the change in vertical orientation of first elevator car 16 and second elevator car 18, first elevator car 16 services the second subset of serviced floors (e.g., the even floors) at 172 and second elevator car 18 services the first subset of serviced floors (e.g., the odd floors) at 174.

At 176, the first elevator car 16 and second elevator car 18 travel downward through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

At 178, first elevator car 16 and second elevator car 18 reach the lobby to allow egress of passengers. Typically, no passengers enter first elevator car 16 or second elevator car 18 at the lobby floor of second hoistway 14. At 179, first elevator car 16 and second elevator car 18 are decoupled. Once decoupled, the second car 18 and first car 16 enter the lower transfer station 32, one at a time. At 180, the second elevator car 18 and first elevator car 16 are transferred horizontally from the second hoistway 14 to the first hoistway 12. The first elevator car 16 and second elevator car 18 change vertical orientation, e.g., the second elevator car 18 is now vertically above the first elevator car 16. Once transferred, first elevator car 16 and second elevator car 18 are sent to the lobby in first hoistway 12, as shown at 160.

Figure 7:
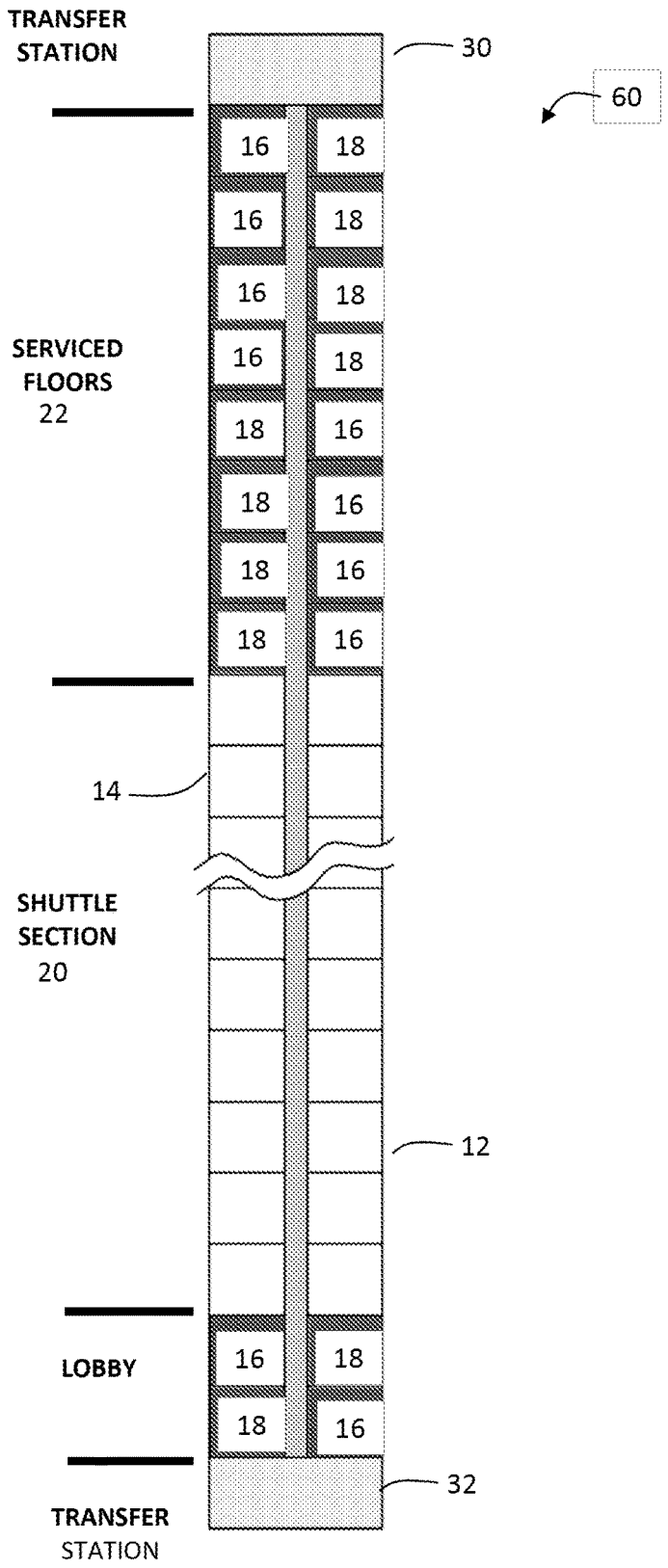
FIG. 7 depicts a multicar elevator system in an exemplary embodiment.

FIG. 7 depicts an elevator system 60 in an exemplary embodiment. The construction of elevator system 60 is similar to that of FIG. 1. In elevator system 60, however, upper transfer station 30 and lower transfer station 32 only accommodate one car at a time, rather than two cars.

Figure 8:
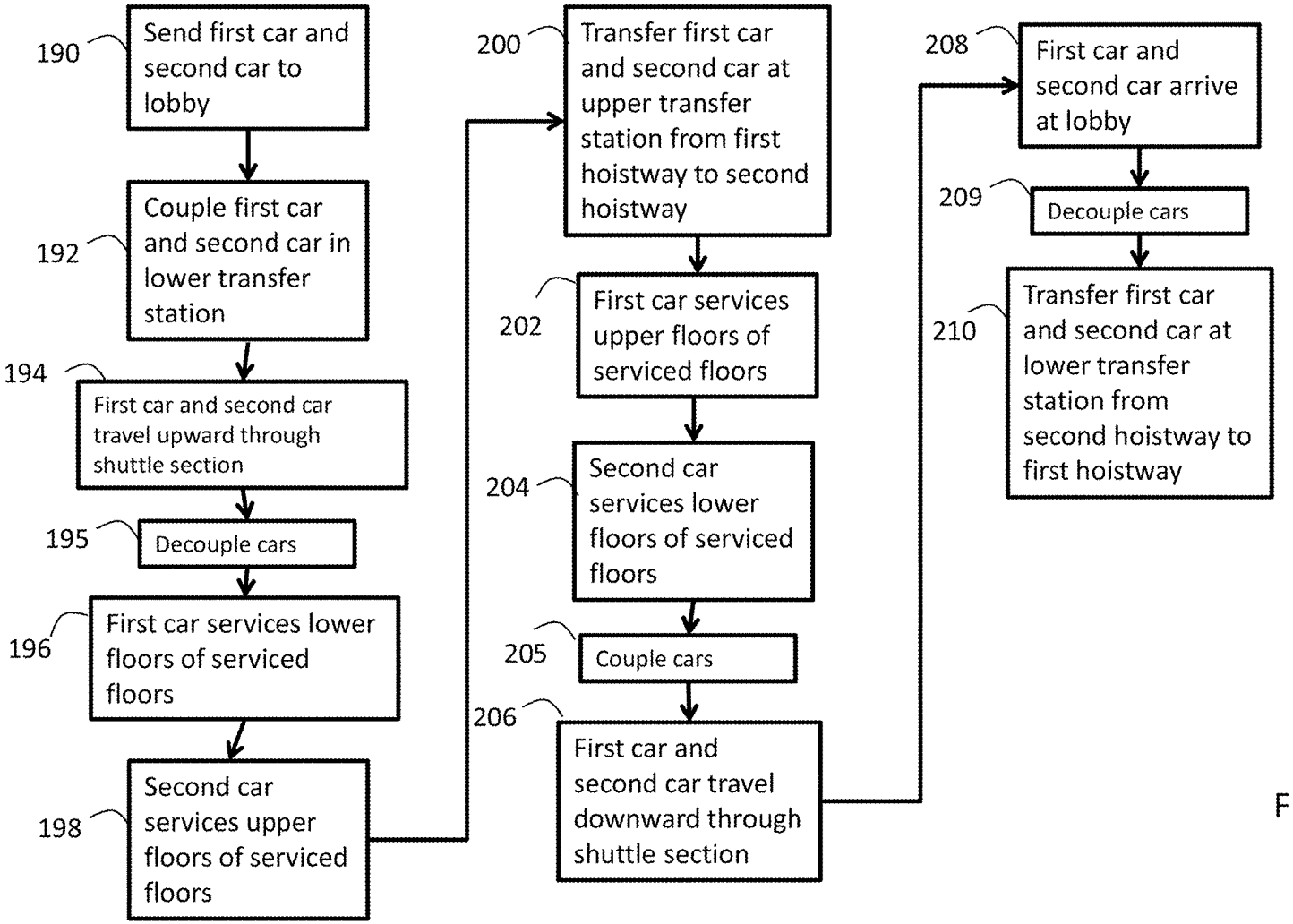
FIG. 8 is a flowchart of a process for operating the elevator system of FIG. 7 in an exemplary embodiment.

FIG. 8 is a flowchart of a process for operating the elevator system of FIG. 7 in an exemplary embodiment. The process begins at 190 where the first car 16 and second car 18 are sent to the lobby. Passengers may be notified of the floors that first elevator car 16 and second elevator car 18 serve, respectively, so that passengers board the appropriate elevator car. At 192, first car 16 and second car 18 are physically coupled by a coupler. This may be done using known couplers, such as electro-mechanical couplers, electro-magnetic couplers, etc.

At 194, the first elevator car 16 and second elevator car 18 travel upward through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

The first elevator car 16 and second elevator car 18 reach the serviced floors 22. At 195, the first elevator car 16 and second elevator car 18 are decoupled. The coupler joining first elevator car 16 and second elevator car 18 may be activated or deactivated by a controller. For example, an electro-mechanical coupler or electro-magnetic coupler may be controlled by control signals from a controller. As such, first elevator car 16 services a first subset of serviced floors 22 (e.g., the lower floors) at 196 and second elevator car 18 services a second subset of serviced floors 22 (e.g., the upper floors) at 198.

Upon traversing the serviced floors, the second car 18 and first car 16 enter the upper transfer station 30, one at a time. At 200, the second elevator car 18 and first elevator car 16 are sequentially transferred horizontally from the first hoistway 12 to the second hoistway 14. The first elevator car 16 and second elevator car 18 change vertical orientation, e.g., the second elevator car 18 is now vertically below the first elevator car 16.

Once transferred, first elevator car 16 and second elevator car 18 begin travel downward in the second hoistway 14. The first elevator car 16 and second elevator car 18 enter the serviced floors 22. The first elevator car 16 and second elevator car 18 remain decoupled. Due to the change in vertical orientation, first elevator car 16 services the second subset of serviced floors (e.g., the upper floors) at 202 and second elevator car 18 services the first subset of serviced floors (e.g., the lower floors) at 204.

At 205, prior to entering shuttle section 20, first elevator car 16 and second elevator car 18 are coupled together. As noted above, the coupler joining first elevator car 16 and second elevator car 18 may be controlled by a controller. At 206, the first elevator car 16 and second elevator car 18 travel downward through shuttle section 20. Since the first elevator car 16 and second elevator car 18 are coupled together, there is no need to control the spacing between the first elevator car 16 and second elevator car 18. As such, first elevator car 16 and second elevator car 18 can travel at an increased speed, relative to systems employing multiple, uncoupled cars traveling in a shuttle section.

At 208, first elevator car 16 and second elevator car 18 reach the lobby to allow egress of passengers. Typically, no passengers enter first elevator car 16 or second elevator car 18 at the lobby floor of second hoistway 14. At 209, first elevator car 16 and second elevator car 18 are decoupled. Once decoupled, the second car 18 and first car 16 enter the lower transfer station 32, one at a time. At 210, the second elevator car 18 and first elevator car 16 are sequentially transferred horizontally from the second hoistway 14 to the first hoistway 12. The first elevator car 16 and second elevator car 18 change vertical orientation, e.g., the second elevator car 18 is now vertically above the first elevator car 16. Once transferred, first elevator car 16 and second elevator car 18 are sent to the lobby, as shown at 190.

Figure 9:
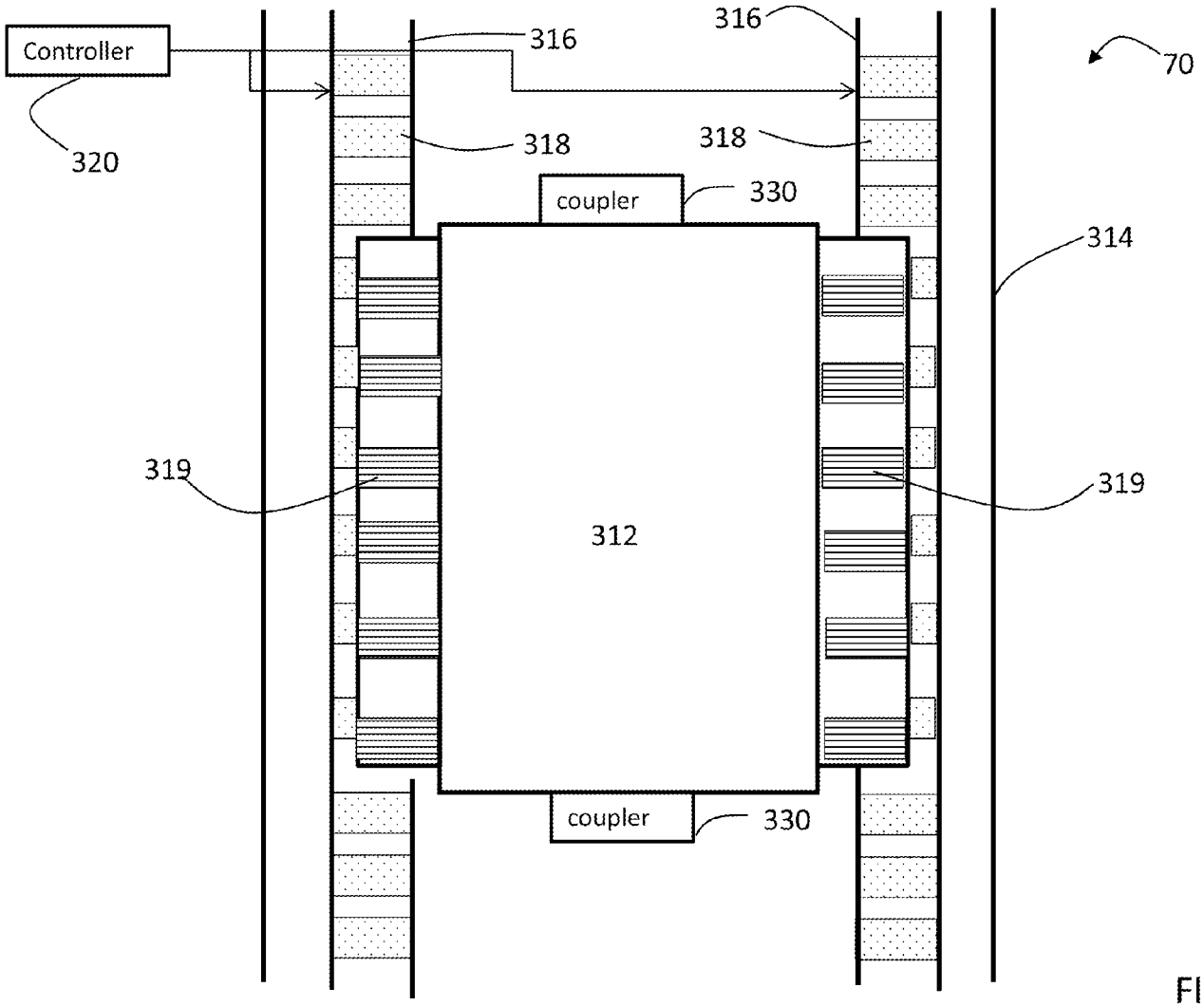
FIG. 9 depicts a self-propelled elevator car in an exemplary embodiment.

Propulsion of the elevator cars 16 and 18 may be achieved in a variety of manners, such as self-propelled or roped. FIG. 9 depicts an elevator system 70 having a self-propelled elevator car 312. Elevator system 70 includes an elevator car 312 that travels in a hoistway 314. Elevator car 312 travels along one or more guide rails 316 extending along the length of hoistway 314. Elevator system 70 employs a linear motor having primary windings 318, which may be provided along guide rails 316 or located separate from guide rails 316. Primary windings 318 may be provided on one or both sides of elevator car 312. The primary windings 318 serve as stator windings of a permanent magnet synchronous motor to impart motion to elevator car 312. Primary windings 318 may be arranged in three phases, as is known in the linear motor art. Permanent magnets 319 may be mounted to car 312 to serve as the secondary moving portion of the permanent magnet synchronous motor.

Also shown in FIG. 9 is a coupler 330, which may be placed at the top and/or the bottom of elevator car 312. As described above, coupler 330 may be implemented using an electro-mechanical or electro-magnetic coupling, that can be engaged or disengaged with a mating coupler in response to control signals from controller 320. If cars do not change relative vertical orientation (FIGS. 1 and 3), then a single coupler 330 may be used on each elevator car. If cars do change relative vertical orientation (FIGS. 5 and 7), then two couplers 330 may be used, one on the top and one on the bottom of each elevator car.

Controller 320 provides drive signals to the primary windings 318 to impart motion to the elevator car 312. Controller 320 may be implemented using a general-purpose microprocessor executing a computer program stored on a storage medium to perform the operations described herein. Alternatively, controller 320 may be implemented in hardware (e.g., ASIC, FPGA) or in a combination of hardware/software. Controller 320 may also be part of an elevator control system. Controller 320 may include power circuitry (e.g., an inverter or drive) to power the primary windings 318.

In other embodiments, first elevator car 16 and second elevator car 18 are roped, that is, conveyed by tension members coupled to the elevator cars and one or more counterweights. A drive unit imparts force to the tension member to transition elevator cars up or down.

Embodiments described herein refer to coupling a first elevator car and a second elevator car. It is understood that more than two elevator cars may be coupled, and embodiments are not limited to coupling two elevator cars.

Embodiments provide a number of benefits. By using multiple cars in a single hoistway, the footprint of the elevator system is reduced, which results in increased utilization of building space for customer. By coupling cars during travel in the shuttle sections, simplified traffic management is used, as cars cannot collide in the shuttle section. This also results in a shorter travel time through the shuttle section, as higher speeds are attainable.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims.

The invention claimed is:

1. An elevator system comprising:

a first hoistway having a shuttle section where no floors are serviced and serviced floors;

a second hoistway having a shuttle section where no floors are serviced and serviced floors;

a first elevator car;

a second elevator car;

a coupler physically connecting the first elevator car and the second elevator car during travel in the shuttle section;

an upper transfer station for transferring at least one of the first elevator car and the second elevator car from the first hoistway to the second hoistway;

a lower transfer station for transferring at least one of the first elevator car and the second elevator car from the second hoistway to the first hoistway;

wherein the first elevator car and the second elevator car are decoupled for servicing the serviced floors.

2. The elevator system of claim 1 wherein:

the upper transfer station transfers the first elevator car and the second elevator car from the first hoistway to the second hoistway at the same time.

3. The elevator system of claim 2 wherein:

the first elevator car and the second elevator car are coupled during transfer from the first hoistway to the second hoistway.

4. The elevator system of claim 1 wherein:

the lower transfer station transfers the first elevator car and the second elevator car from the second hoistway to the first hoistway at the same time.

5. The elevator system of claim 4 wherein:

the first elevator car and the second elevator car are coupled during transfer from the second hoistway to the first hoistway.

6. The elevator system of claim 1 wherein:

during travel in the first hoistway, the first elevator car services a first subset of the serviced floors and the second elevator car services a second subset of the serviced floors.

7. The elevator system of claim 6 wherein:

during travel in the second hoistway, the first elevator car services the first subset of the serviced floors and the second elevator car services the second subset of the serviced floors.

8. The elevator system of claim 1 wherein:

the upper transfer station transfers the first elevator car and the second elevator car from the first hoistway to the second hoistway one at a time.

9. An elevator system comprising:

a first hoistway having a shuttle section and serviced floors;

a second hoistway having a shuttle section and serviced floors;

a first elevator car;

a second elevator car;

a coupler physically connecting the first elevator car and the second elevator car during travel in the shuttle section;

an upper transfer station for transferring at least one of the first elevator car and the second elevator car from the first hoistway to the second hoistway;

a lower transfer station for transferring at least one of the first elevator car and the second elevator car from the second hoistway to the first hoistway;

wherein the upper transfer station transfers the first elevator car and the second elevator car from the first hoistway to the second hoistway one at a time;

wherein the first elevator car and the second elevator are coupled for servicing the serviced floors in the first hoistway, decoupled prior to entering the upper transfer station, and coupled prior to servicing the serviced floors in the second hoistway.

10. The elevator system of claim 9 wherein:

during travel in the first hoistway, the first elevator car services a first subset of the serviced floors and the second elevator car services a second subset of the serviced floors, during travel in the second hoistway, the first elevator car services the second subset of the serviced floors and the second elevator car services the first subset of the serviced floors.

* * * * *